United States Patent [19]

Wolbrink

[11] 4,047,775

[45] Sept. 13, 1977

[54] DEODORIZER FOR TRASH COMPACTORS

[75] Inventor: David W. Wolbrink, Hartford, Wis.

[73] Assignee: Broan Manufacturing Co., Inc., Hartford, Wis.

[21] Appl. No.: 613,922

[22] Filed: Sept. 16, 1975

[51] Int. Cl.[2] ..... B30B 15/00

[52] U.S. Cl. ..... 312/211; 312/31.3; 100/45; 21/83

[58] Field of Search ..... 312/211, 31.01, 31.3; 100/45; 21/83

[56] References Cited

U.S. PATENT DOCUMENTS

| | | | |
|---|---|---|---|
| 2,539,059 | 1/1951 | Cohn | 21/83 |
| 2,793,742 | 5/1957 | Mintz | 312/31.3 |
| 3,382,020 | 5/1968 | Meri | 312/31.01 |
| 3,556,619 | 1/1971 | Bottas et al. | 312/211 |
| 3,636,862 | 1/1972 | Bottas et al. | 312/211 |
| 3,839,952 | 10/1974 | McDonald et al. | 100/45 |
| 3,926,107 | 12/1975 | Dunlap et al. | 100/45 |

*Primary Examiner*—Paul R. Gilliam
*Assistant Examiner*—Victor N. Sakran
*Attorney, Agent, or Firm*—Andrus, Sceales, Starke & Sawall

[57] ABSTRACT

A deodorizer containing a deodorant material is mounted within the cabinet of a trash compactor for continuously releasing a scent to the air in the cabinet to mask odors emanating from the compacted trash.

2 Claims, 2 Drawing Figures

DEODORIZER FOR TRASH COMPACTORS

BACKGROUND OF THE INVENTION

1. Field of the Invention

The present invention relates to a deodorizing means for compactors of the home appliance type.

2. Description of the Prior Art

Compactors for compressing household waste or trash have come into use in recent years. Such appliances include a ram or platen which descends into a bin or receptacle containing the trash to effect the compaction. The receptacle may be mounted in a drawer which is slidable out of the compactor to deposit trash to be compacted and to remove the compacted trash. The receptacle is usually designed so that at least several days, and more often, a week's compacted trash may accumulate in the bin before the bin becomes filled and it is necessary to carry the compacted trash out to the garbage.

Given the high food waste content of household trash, it will be readily appreciated that offensive and undesirable odors will emanate from the trash prior to its disposal. As a result, it is a common practice to provide a means for masking the odors of the compacted trash.

Typically, an aerosol spray container is provided which sprays a deodorant on the trash. However, the use of an aerosol spray container suffers several shortcomings. In some schemes, the aerosol container is mounted in the compactor cabinet and activated by opening the door through which the trash is inserted or removed from the trash compactor. This often causes the aerosol to squirt on the user's hand as the trash is inserted or removed.

In other arrangements, the aerosol spray is activated by the descent of the ram. Since deodorant is not usually needed at this time, because the compaction process serves to suppress odors, this approach is inefficient.

Still other schemes provide a means which may be actuated by the home owner to provide the aerosol spray. However, this requires the odor rise to obnoxious levels before the user takes corrective action.

In all of the foregoing arrangements, intermittent deodorization of the compacted trash is provided by the aerosol spray.

SUMMARY OF THE PRESENT INVENTION

In contrast to existing deodorizers which operate on the intermittent principle, the present invention contemplates a deodorizer means for trash compactors which continuously deodorizes the trash in the interior of the compactor.

The present invention provides a deodorizing arrangement which establishes a stratum of deodorant laden air in the upper part of the trash compacting chamber which is particularly effective in separating the user of the compactor from the odors of the trash lying in the receptacle.

Briefly, the present invention contemplates a means containing a deodorant material positioned within the cabinet of a trash compactor. The deodorant material continuously releases a scent into the air within the compactor for masking the trash odors. The deodorizing means is preferably positioned above the receptacle where the restricted air circulation forms a heavily scented air layer which separates the user from the odors in the receptacle. This heavily scented air may be expelled from the compactor cabinet upon the opening and closing of the drawer containing the receptacle thereby producing a pleasing effect on the user.

DESCRIPTION OF THE PREFERRED EMBODIMENT

Figures 1, 2:
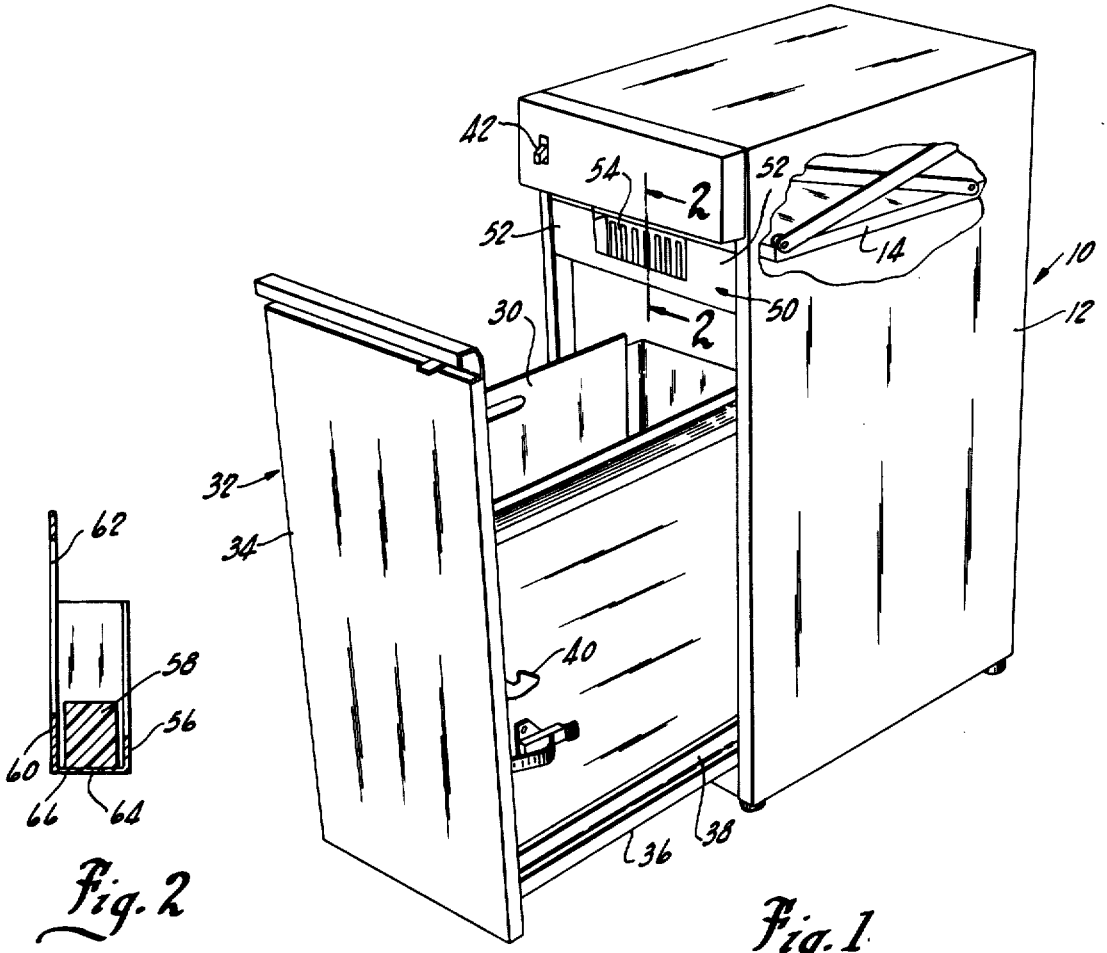
FIG. 1 is a perspective view of a trash compactor showing the improved deodorizing means of the present invention.
FIG. 2 is an enlarged cross sectional view taken along line 2—2 of FIG. 1 showing in greater detail the deodorizing means of the present invention.

Turning now to the Figures, there is shown in FIG. 1 a trash compactor identified by the numeral 10. Trash compactor 10 includes cabinet 12 containing a compacting mechanism, not shown, in the upper portions thereof by which platen or ram 14 may be made to descend for the compaction of trash and return to the upper storage position shown in FIG. 1.

Receptacle 30 for receiving the trash to be compacted is positioned in the lower portion of cabinet 12. Access to the interior of cabinet 12 is provided by a drawer 32 having a drawer front panel 34 formed of one of the vertical walls of cabinet 12. A support deck 36 on which receptacle 30 rests is attached to the lower portions of drawer front panel 34. Drawer front panel 34 is preferably higher than receptacle 30. Drawer 32 is movable into and out of cabinet 12 on horizontal rails 38 and is held in the closed position by catch 40.

In operation, drawer 32 is opened, the trash to be compacted deposited in receptacle 30, and the drawer closed. Switch 42 is closed to actuate the compacting mechanism through an operating cycle in which ram 14 is driven into and out of receptacle 30. Drawer 32 is then opened to deposit more trash and the operating cycle repeated until receptacle 30 is full. As noted supra, most trash compactors are designed so that the trash ordinarily produced by a typical family in a week may be accommodated in receptacle 30 before the receptacle must be removed from the compactor and emptied.

During the week period in which trash accumulates in receptacle 30, offensive and undesirable odors will develop both from the food scraps in the trash and from the microbiological activity occurring over such a period at room temperature.

The improved deodorizing means of the present invention for masking such odors is identified by the numeral 50. As shown in FIG. 1, deodorizing means 50 is located across the opening in cabinet 12 formed by drawer front panel 34. Deodorizing means 50 includes a pair of spacers 52 which abut the inner surface of drawer front panel 34 when drawer 32 is closed. Between spacers 52 a holder in the form of a tray 54 is formed in which a deodorant material may rest. As shown in FIG. 2, tray 54 includes forward lip 56 which retains deodorant material 58 in the tray, a rear wall 60 containing slots 62 and slot 64 in bottom wall 66. The slots permit the air to circulate over deodorant material 58 and the scent of the deodorant to diffuse.

Many types of deodorant material may be used. For exemplary purposes, the deodorant material is shown in the Figures as a deodorant incorporated in a binder and formed into a block. It will be appreciated that numerous other types of deodorants may be used including an impregnated plastic, such as permeable polyethylene, a liquid deodorant applied by a wick, and the like.

With drawer 32 closed, deodorant material 58 continuously deodorizes the air within cabinet 12, thereby masking odors arising from the compacted trash. Because of the limited air circulating within cabinet 12 and because of the location of deodorant material 58 above receptacle 30, a stratum of air, heavily scented with the deodorant, tends to form above receptacle 30. When drawer 32 is opened and particularly when drawer 32 is closed, this stratum of air is expelled into the room exposing the user bending over the compactor to a pleasing odor and separating him from the odors produced by the trash laying in receptacle 30. It also assures the user that adequate deodorization is occurring.

While a compactor 10 having a cabinet 12 is shown, it will be appreciated that the deodorizer means of the present invention is equally suitable for use with a compactor of the built-in type which is enclosed, for example, by kitchen cabinetry. In such a compactor, a frame work having a front wall is provided for mounting compaction mechanism 14 and for receiving drawer 32.

Various modes of carrying out the invention are contemplated as being within the scope of the following claims particularly pointing out and distinctly claiming the subject matter which is regarded as the invention.

I claim:

1. A trash compactor comprising: an enclosure including a means for positioning a compacting mechanism in the upper portion thereof, said enclosure having a front panel with an opening in the lower portion containing a drawer moveable between an open position and a closed position with respect to said enclosure; a receptacle mounted on said drawer and having an open upper end at which the trash is exposed for emitting offensive odors to the air within the enclosure, said compacting mechanism entering the open end of said receptacle for compacting the trash; and an odor control means having a tray-like holder mounted on said positioning means above the receptacle and across the opening in the front panel of the enclosure, said holder containing an odor treatment material continuously applying an odor treatment substance to the air for treating the air within said enclosure for modifying the odor laden air to reduce its offensiveness, said holder having generally parallel front and back walls and a bottom wall and being open at the top, said front wall having an entry through which the odor treatment material is insertable in the holder, said rear wall having a plurality of openings of a size sufficient to permit an unimpeded flow of air therethrough, said openings forming, with said entry in the front wall of said holder, an air passage through said holder and across said odor treatment material for forming a heavily treated stratum of air along the top of receptacle expellable from said enclosure by movement of the drawer between the open and closed positions.

2. The trash compactor of claim 1 wherein said odor treatment means comprises deodorant means releasing scent into the air within the enclosure.

* * * * *